US011982280B2

(12) United States Patent
Dumonceaux

(10) Patent No.: US 11,982,280 B2
(45) Date of Patent: May 14, 2024

(54) IN-LINE PUMPING APPARATUS, SYSTEM AND METHOD FOR INCREASING LIQUID FLOW IN GRAVITY NETWORKS

(71) Applicant: INDUSTRIAL FLOW SOLUTIONS OPERATING, INC., New Haven, CT (US)

(72) Inventor: Stephane Dumonceaux, Burcy (FR)

(73) Assignee: INDUSTRIAL FLOW SOLUTIONS OPERATING, INC., New Haven, CT (US)

( * ) Notice: Subject to any disclaimer, the term of this patent is extended or adjusted under 35 U.S.C. 154(b) by 23 days.

(21) Appl. No.: 17/642,657

(22) PCT Filed: Nov. 27, 2019

(86) PCT No.: PCT/US2019/063767

§ 371 (c)(1),
(2) Date: Mar. 11, 2022

(87) PCT Pub. No.: WO2020/113113

PCT Pub. Date: Jun. 4, 2020

(65) Prior Publication Data

US 2022/0325724 A1 Oct. 13, 2022

Related U.S. Application Data

(60) Provisional application No. 62/904,652, filed on Sep. 23, 2019.

(51) Int. Cl.
*F04D 15/02* (2006.01)
*E03F 5/22* (2006.01)
(Continued)

(52) U.S. Cl.
CPC ..... *F04D 15/029* (2013.01); *E03F 5/22* (2013.01); *F04D 13/06* (2013.01); *F04D 13/12* (2013.01);
(Continued)

(58) Field of Classification Search
CPC .... F04D 15/029; F04D 13/14; F04D 15/0066; F04D 15/0088; F04D 13/06;
(Continued)

(56) References Cited

U.S. PATENT DOCUMENTS 2,347,544 A 4/1944 De Costa et al.
2,421,066 A 5/1947 Howe
(Continued)

FOREIGN PATENT DOCUMENTS

FR 2837244 A1 * 9/2003 ..... E03F 5/22
FR 2837244 A1 9/2003
WO 2019193010 A1 10/2019

OTHER PUBLICATIONS

Mariana Dias De Silva, Technical Examination Report, Brazilian National Institute of Industrial Property, Rio de Janeiro, Apr. 4, 2023.

*Primary Examiner* — Peter J Bertheaud
(74) *Attorney, Agent, or Firm* — Wasserbauer Law, LLC; Damian G. Wasserbauer, Esq.; Nicholas E. Blanton, Esq.

(57) ABSTRACT

The invention, comprises a pumping apparatus, system and method for increasing the flow of the in a first direction to boost liquid flow and in a reverse second direction to remove blockages and/or self-clearing, with operation having an rotor/impeller that can use a shredder and/or shearing action utilizing blades for processing to pass solids, debris and other things to prevent clogging and/or self-cleaning of the unit.

9 Claims, 7 Drawing Sheets

(51) Int. Cl.

| | |
|---|---|
| ***F04B 23/04*** | (2006.01) |
| ***F04B 49/02*** | (2006.01) |
| ***F04B 49/06*** | (2006.01) |
| ***F04D 13/06*** | (2006.01) |
| ***F04D 13/12*** | (2006.01) |
| ***F04D 13/14*** | (2006.01) |
| ***F04D 15/00*** | (2006.01) |
| ***F04D 29/22*** | (2006.01) |
| ***F04D 29/70*** | (2006.01) |

(52) U.S. Cl.
CPC ..... *F04D 13/14* (2013.01); *F04D 15/0066* (2013.01); *F04D 15/0072* (2013.01); *F04D 15/0088* (2013.01); *F04D 15/0209* (2013.01); *F04D 15/0218* (2013.01); *F04D 29/2283* (2013.01); *F04D 29/708* (2013.01); *F04B 23/04* (2013.01); *F04B 49/02* (2013.01); *F04B 49/065* (2013.01); *F04B 2203/0209* (2013.01)

(58) Field of Classification Search
CPC ..... F04D 15/0209; F04D 29/2283; F04D 29/708; F04D 15/0072; F04D 15/0218; F04D 13/12; E03F 5/22; F04B 49/02; F04B 49/065; F04B 2203/0209; F04B 23/04
USPC ..... 417/3–8
See application file for complete search history.

(56) References Cited

U.S. PATENT DOCUMENTS

| | | | | |
|---|---|---|---|---|
| 2,569,102 | A | 9/1951 | Howe | |
| 2,701,026 | A | 2/1955 | Howe | |
| 2,739,662 | A | 3/1956 | Antonio | |
| 2,747,678 | A | 5/1956 | Howe | |
| 2,844,163 | A | 7/1958 | Steinberg | |
| 3,811,463 | A | 5/1974 | Dickens | |
| 9,726,179 | B2 * | 8/2017 | Dumonceaux | F04D 7/045 |
| 2015/0023783 | A1 | 1/2015 | Dumonceaux | |

* cited by examiner

IN-LINE PUMPING APPARATUS, SYSTEM AND METHOD FOR INCREASING LIQUID FLOW IN GRAVITY NETWORKS

TECHNICAL FIELD

The invention relates to the technical field of pumping liquids in pipes and, in particular, to a pumping apparatus, system and method for increasing the flow of liquid in a gravity feed network in a first direction and in a reverse second direction to remove blockages and/or self-clearing that advantageously eliminates the need for a wet well.

BACKGROUND ART installed wastewater drainage systems in cities, towns and rural areas using a gravity feed design can reach maximum capacity and overflow conditions. Most gravity feed designs utilize a submerged pumping device in a tank and/or wet well. When the pumping device has a failure, its repair imposes a complete interruption of the pumping, drainage of the tank, and additional costs. Some installations utilize another backup pumping device or second pumping station that is also an additional cost.

There is a need for a solution to increase capacity of existing gravity feed designs in a cost effective way. Gravity feed infrastructure is can reach maximum capacity of the flow of liquid due to increased precipitation, rains, floods, and other environmental conditions in short amounts of time that overloads the system. For example, a rainwater discharge pipe of a parking surface of the same size, dimensioned for a flow rate corresponding to a so-called downtime frequency precipitation, will not be able to evacuate more fluids in the event of higher precipitation, that cause the parking lot to flood as long as the precipitation intensity lasts. Similarly, a wastewater collector sized for a maximum number of simultaneous users must be replaced by a higher and/or larger section of pipe if, even for a limited period of time, the population connected to this wastewater collector exceeds this maximum number of simultaneous users, for example, high volume used in tourist areas. Infrastructure replacement solutions to increase a maximum capacity of the flow of liquid in the pipe seek to increase the capacity and/or sectional volume of the pipes of the gravity feed network. Currently there are no solutions for gravity sewage pipe designs for increasing the maximum flow without increasing the internal section of the gravity piping and/or varying other factors such as slope, coefficient of resistance, and pressure.

In addition, in-line pumps can be clogged by items and objects from the rain and/or waste water causing pump failure such as, for example, articles of clothing, fabric wipes, diapers, organic matter, e.g. manure, sewage or stringy materials, such as hay, straw, paper or rags, and other items. These clogging factors have presented problems in conventional gravity feed networks. Consequently, there is a long felt need for a solution to increase the flow of liquids on demand in gravity feed networks to process wastewater and large amounts of precipitation in a short amount of time without clogging and the need for costly infrastructure.

DISCLOSURE OF THE INVENTION

The invention provides a liquid pumping apparatus, system and method for increasing the flow of liquid in a gravity feed network having an inlet pipe and an outlet pipe, comprising: a main conduit comprising a main body with an upstream portion, a downstream portion, a manifold portion, one or more inlet connecting conduits having a body operably connected at one end to the upstream portion and at another end a lower portion of a pump body, and one or more outlet connecting conduits having a body operably connected at one end to the downstream portion and/or the manifold portion and at another end an upper portion of the pump body, the main conduit adapted to directly connect to an inlet pipe and an outlet pipe of the gravity feed network so as to receive liquid flow; a check valve operably connected in the manifold portion of the main conduit, the check valve operable between a first position and a second position to interrupt or resume the liquid flow; at least one sensor adapted to determine a predetermined value of the liquid flow located in the main conduit; one or more pumps connected to the pump body thereby directly connecting each pump to the inlet connecting conduit and to the output connecting conduit, each of the one or more pumps having a motor operably connected to an impeller formed by one or more plates secured on a disc and one or more blades located on a side of the one or more plates, the motor configured to operate in a forward direction to drive the impeller and in a reverse direction to allow the one or more blades to clear any blockage in the one or more inlet connecting conduits; and a control electrically connected to each of the one or more pumps and to the sensor, the control adapted to energize the motor in the one or more pumps when the arrival of the liquid flow in the main conduit is above the predetermined value of the liquid flow in the main conduit.

An object of the invention is to provide an apparatus, system and method with a significant increase in the flow rate of the pipe on which it is applied once the pipe has achieved its maximum gravity flow without increasing the internal section, without accentuating its slope, and without additional pressure, with a coefficient of resistance, e.g. without replacing the pipe and having equal slope and roughness.

It is another object of the invention to incorporate wastewater pumps having an impeller operating in a forward direction to increase the flow of the liquid and that can use a shredder in a reverse direction to pass solids, prevent clogging and to self-clean the conduits and pumping system.

It is yet another an object of the invention to provide remote sensing, control and management capabilities to save maintenance time and operational costs.

The invention provides a non-clogging submersible reversible pump in which solid or stringy material is chopped as necessary for passage through the discharge port of the pump. One or more rotor blades of the pump cut the material and force the liquid containing such material upward through a discharge port. The chopped material is of a size that the impeller cannot be clogged with such chopped material and discharge in the upper part of the gravity pipe main duct to the outlet.

Another object is to provide one or more pumps operably connected to one or more conduit portions that are connected to a main duct for increasing the flow of the liquid. One or more input connecting conduits may be located on an upstream portion of the gravity pipe main duct to operably connect to the input flow of liquid into the main duct. Similarly, one or more output connecting conduits can connect at one end to the outlet of a pump housing for discharging increased flow F' from the pump and at another end connected to the main duct on a downstream portion and/or manifold portion. The one or more input and output connecting conduits may include a connection for one or more pumps, for example, a pump can be connected to a input connecting conduit by a flange connection to the pump body thereby connecting to the input flow F' from the upstream portion of the main duct and an output connecting conduit connecting discharged increased flow F' from the plates of the impeller to a output port in the pump body to discharge the pumped liquid to flow in the downstream portion and/or manifold portion.

Each of the pumps may contain one or more blades on a rotor operating in a reverse direction R for shredding solids and debris in the liquid flow F' to reduce particle size so as to pass to the output port. In this manner, the invention increases the flow of the liquid on demand during adverse conditions advantageously of a lower cost when compared to installing new gravity piping in a simplicity of structure providing economical construction, increased volume and continuous flow of material using a controllable submersible wastewater pumping apparatus.

An object of this invention is to provide a non-clogging pump that features of a reversible pump having a rotor with one or more bi-directional blades in order to a better pumping action and continuous flow of liquid material containing foreign matter that would clog conventional centrifugal pumps.

BRIEF DESCRIPTION OF THE DRAWINGS

Non-limiting and non-exhaustive embodiments of the present invention are described with reference to the following drawings. In the drawings, like reference numerals refer to like parts throughout the various figures unless otherwise specified.

For a better understanding of the present invention, reference will be made to the following Description of Embodiments, which is to be read in association with the accompanying drawings, which are incorporated in and constitute a part of this specification, show certain aspects of the subject matter disclosed herein and, together with the description, help explain some of the principles associated with the disclosed implementations, wherein.

DESCRIPTION OF EMBODIMENTS

Figure 1:
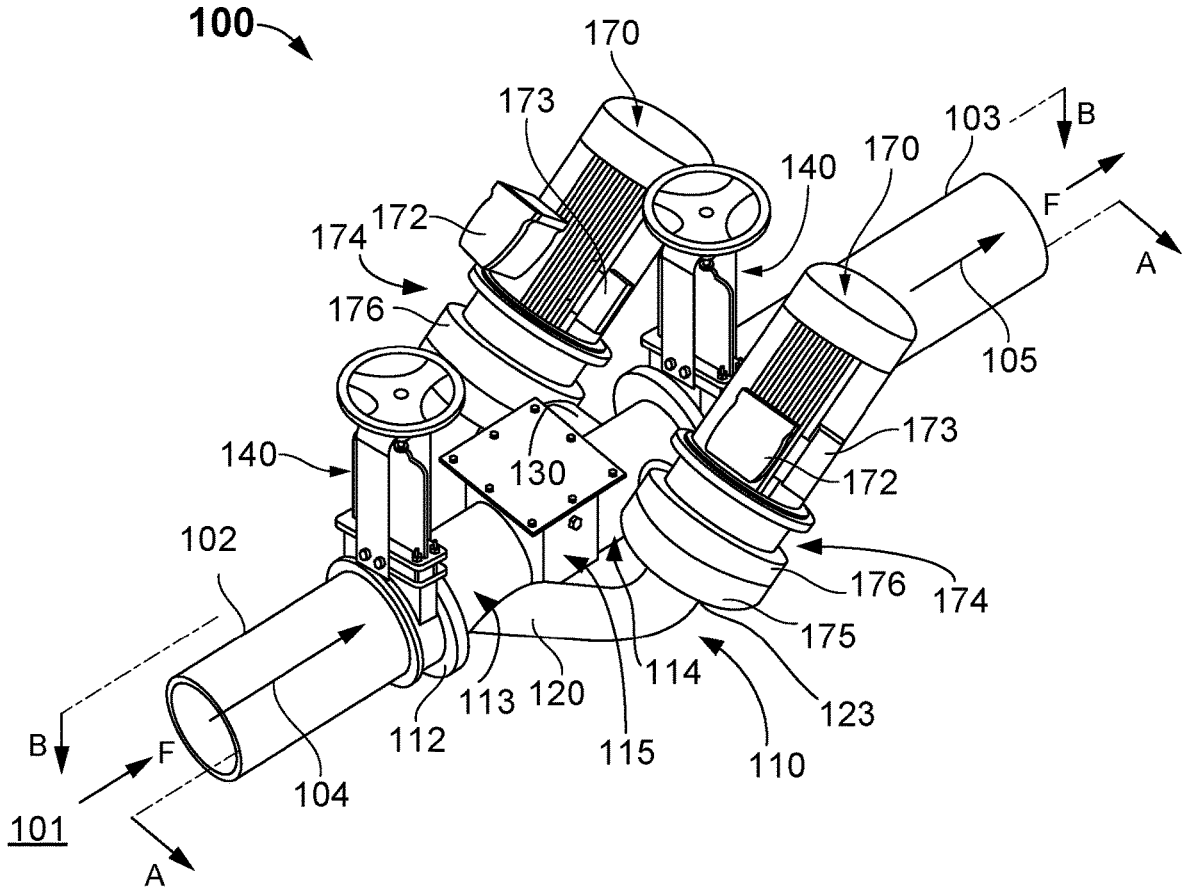
FIG. 1 is a schematic, perspective view of the liquid pumping apparatus, system, and method in accordance with an embodiment of the present invention.
Figure 2A:
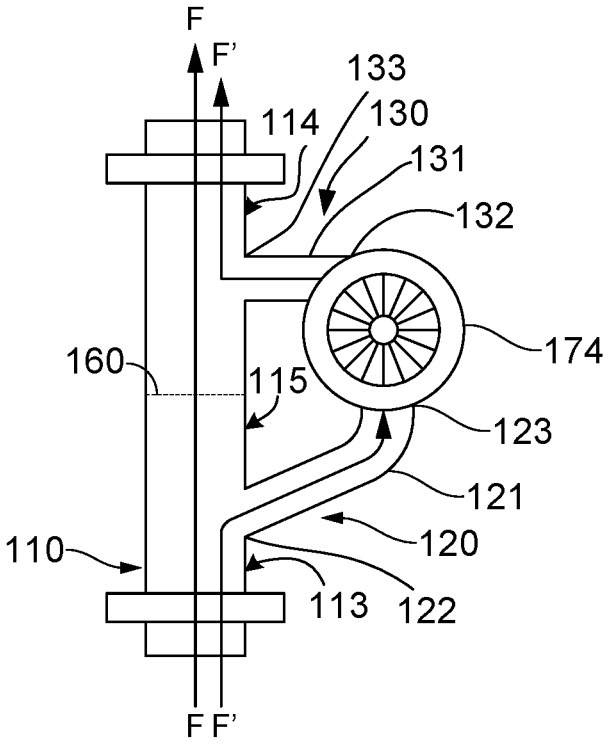
FIG. 2A is a schematic cross-sectional view of the main conduit with flow F with the check valve in the second position and flow F' with the check valve in the first position input and output connecting conduit.
Figure 2B:
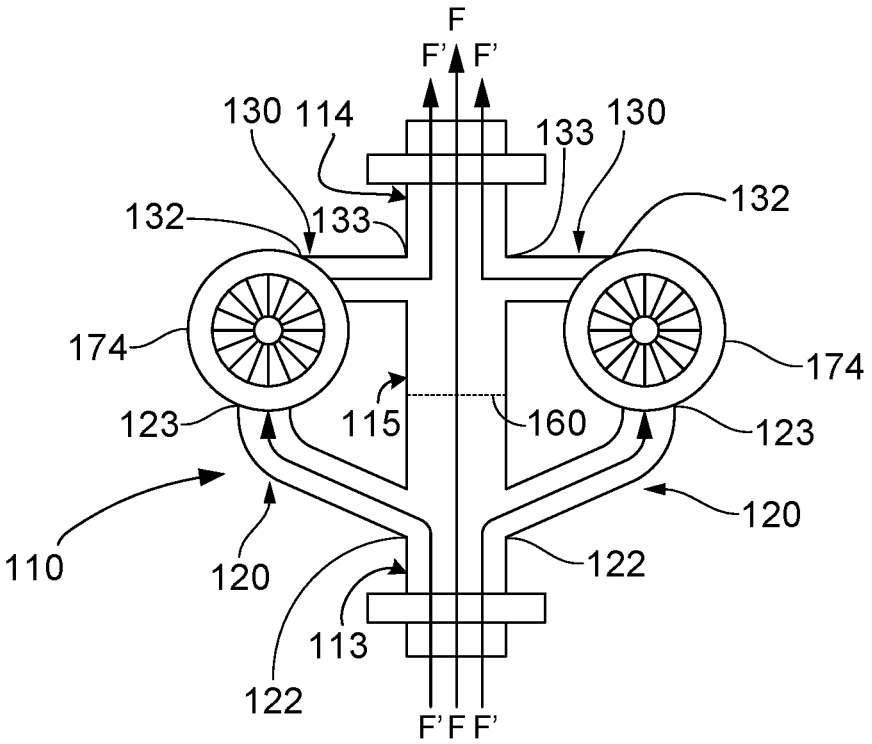
FIG. 2B is a schematic cross-sectional view, taken along lines A-A of FIG. 1, with flow F with the check valve in the second position and flow F' with the check valve in the first position through input and output connecting conduits.

Non-limiting embodiments of the present invention will be described below with reference to the accompanying drawings, wherein like reference numerals represent like elements throughout. While the invention has been described in detail with respect to the preferred embodiments thereof, it will be appreciated that upon reading and understanding of the foregoing, certain variations to the preferred embodiments will become apparent, which variations are nonetheless within the spirit and scope of the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "some embodiments", "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps or acts are in some way inherently mutually exclusive.

The drawings featured in the figures are provided for the purposes of illustrating some embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

Figure 3:
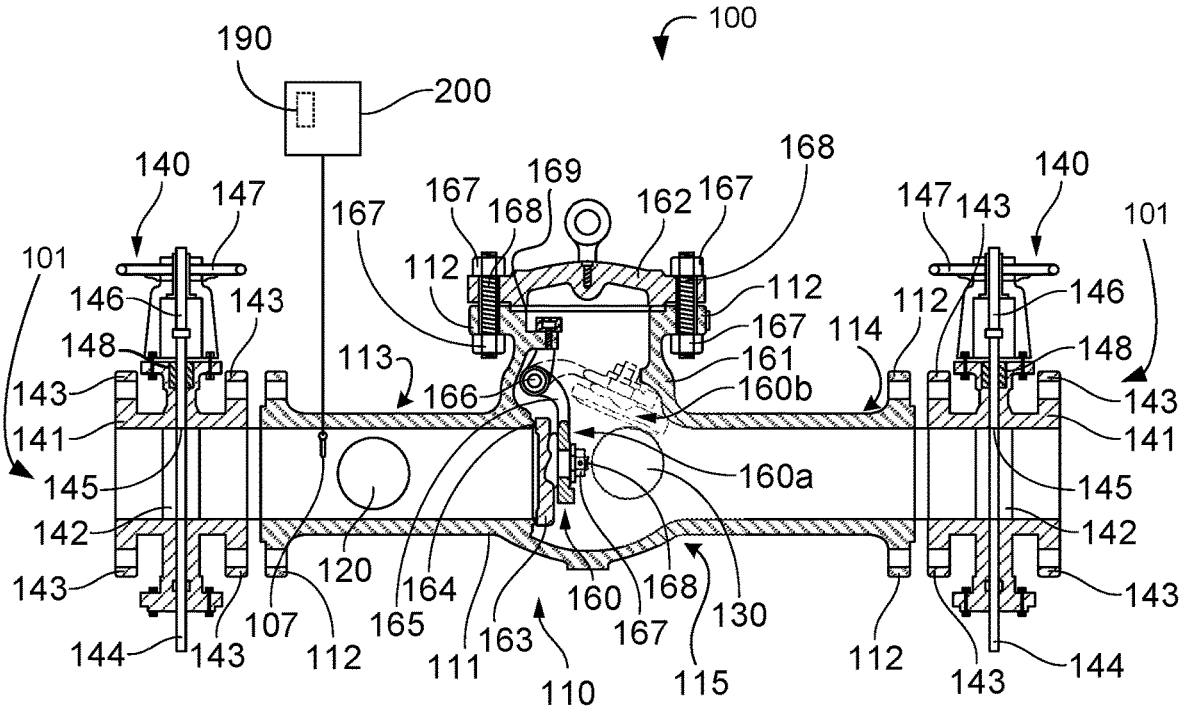
FIG. 3 is a schematic cross sectional view of the pumping apparatus, system and method, taken along lines 3-13 of FIG. 1.

As is illustrated in FIGS. 1-7, a liquid pumping apparatus, system, and method is generally designated as element 100. The invention is described in the environment of an in-line pipe installation in a gravity feed network 101 applied to an inlet pipe 102 and flowing to an outlet pipe 103. The gravity feed network 101 has a flow F that can be described as an inlet flow 104 and an outlet flow 105 of liquid from sources such as, for example, wastewater with solids, fibrous, sediment, and other objects. As shown in FIG. 3, a pressure transducer or sensor probe 107 may be secured in an upstream portion 113 for measuring the pressure and/or the height of liquid in the inlet flow 104 such as, for example, the sensor probe 107 can be an analog pressure sensor sufficient for measuring the height of liquid and transmitting an electrical signal to a control 190 and/or control system 200. The invention may be suitable for other environments where the flow is to be accelerated using the features, structures, or characteristics of the liquid pumping apparatus and/or system 100 and the may be combined without limitation in any suitable manner in one or more embodiments.

According to an embodiment of the present invention, as illustrated in FIGS. 1-3, and 5, the main conduit 110 can be configured with a body 111 formed of a uniform length of a pipe section formed between the inlet pipe 102 and the outlet pipe 103 of the gravity feed network 101. The body 111 includes one or more flanges 112 formed on an upstream portion 113, formed on a downstream portion 114, and formed on a manifold portion 115. According to an embodiment of the invention, the one or more flanges 112 operably connect the inlet pipe 102 and/or a gate valve or closure member 140 to the upstream portion 113, operably connect the outlet pipe 103 and/or closure member 140 to the downstream portion 114, and to operably connect a cover plate 162 to the manifold portion 115 for providing access a check valve 160 located in the manifold portion 115.

As illustrated in FIGS. 1, 2A, 2B and 3-6, the main conduit 110 can have one or more inlet connecting conduits 120 connected to the body 111 at the upstream portion 113 as well as one or more output connecting conduits 130 connected to the downstream portion 114 and/or the manifold portion 115. Closing the check valve 160 in the first position 1160 diverts flow F to allow liquid flow F'. Each of the one or more inlet connecting conduits 120 comprises a body 121 having an end 122 connected the main conduit 110 at the upstream portion 113, and another end 123 connected to the pump body 174 to allow increased liquid flow F'. Each of the one or more outlet connecting conduits 130 comprises a body 131 having an end 132 connected to the pump body 174 and another end 133 connected to the main conduit 110 at the downstream portion 114 and/or the manifold portion 115 to allow increased liquid flow F'.

As shown in FIGS. 1 and 3-7, a closure member 140 is used to control the flow F direction into the main conduit 110 such as, for example, a gate or shutter valve that moves in a straight line into the seating area at right angles to the direction of liquid flow F. One or more closure members 140 can be secured by flanges 112 disposed on the upstream and/or downstream portions 113, 114 of the pipe section of the main conduit 110. The closure member 140 is configured to control flow or pressure for servicing and/or removal of the liquid pumping apparatus and/or system 100 by mechanically obstructing flow of the fluid into the pipe section of the main conduit 110.

Figure 4:
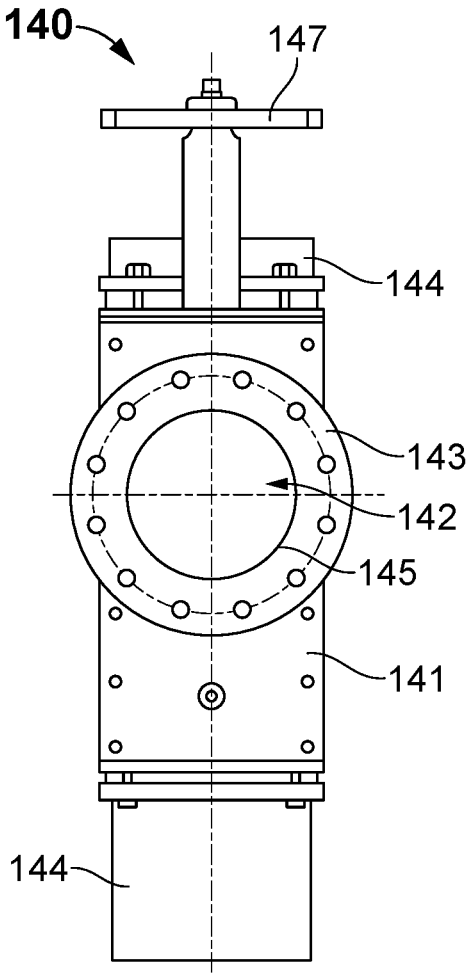
FIG. 4 is a front view illustrating the closure member according to an embodiment of the invention.
Figure 5:
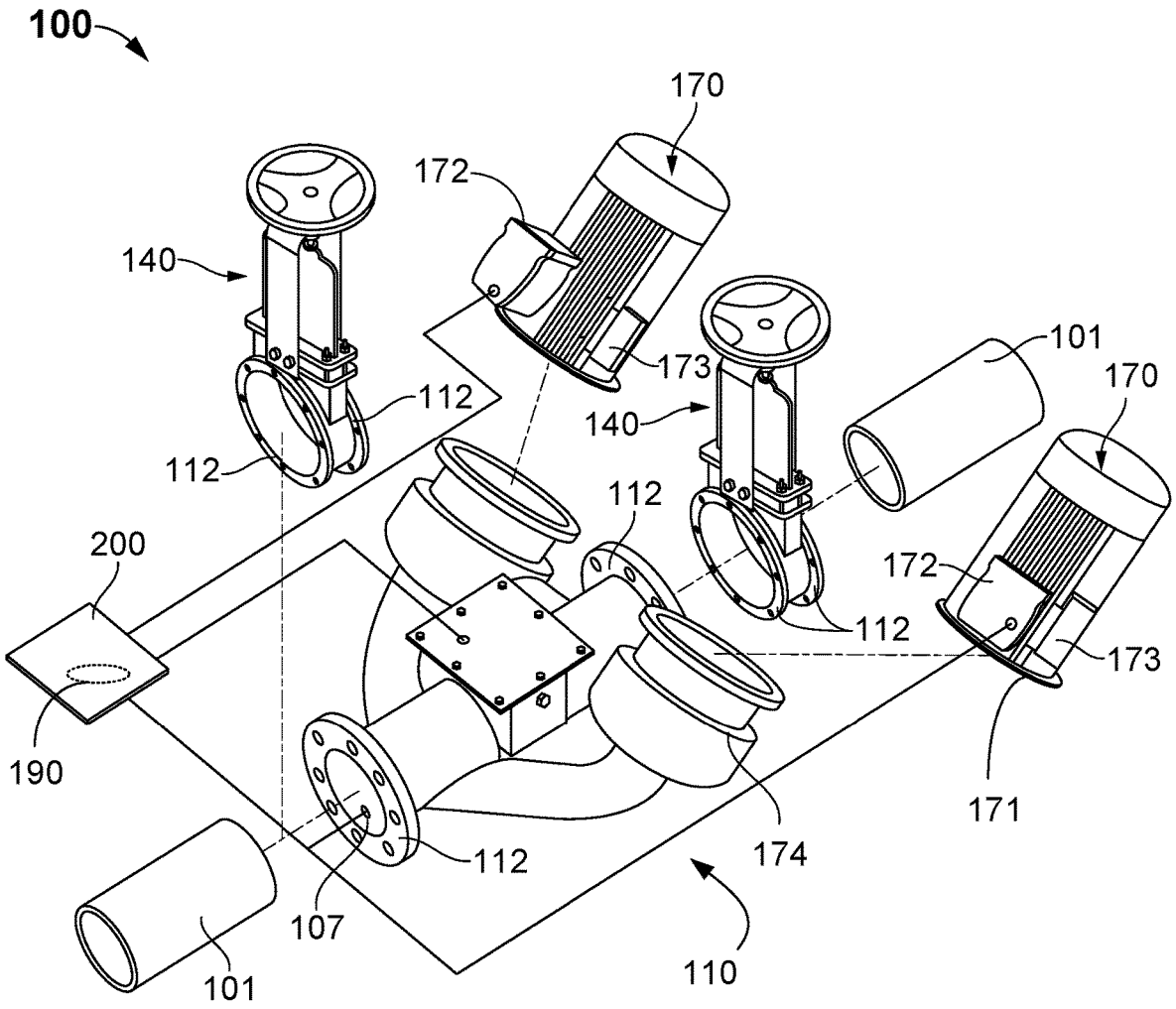
FIG. 5 is a perspective, exploded view illustrating the pumping apparatus, system and method according to an embodiment of the present invention.
Figure 6:
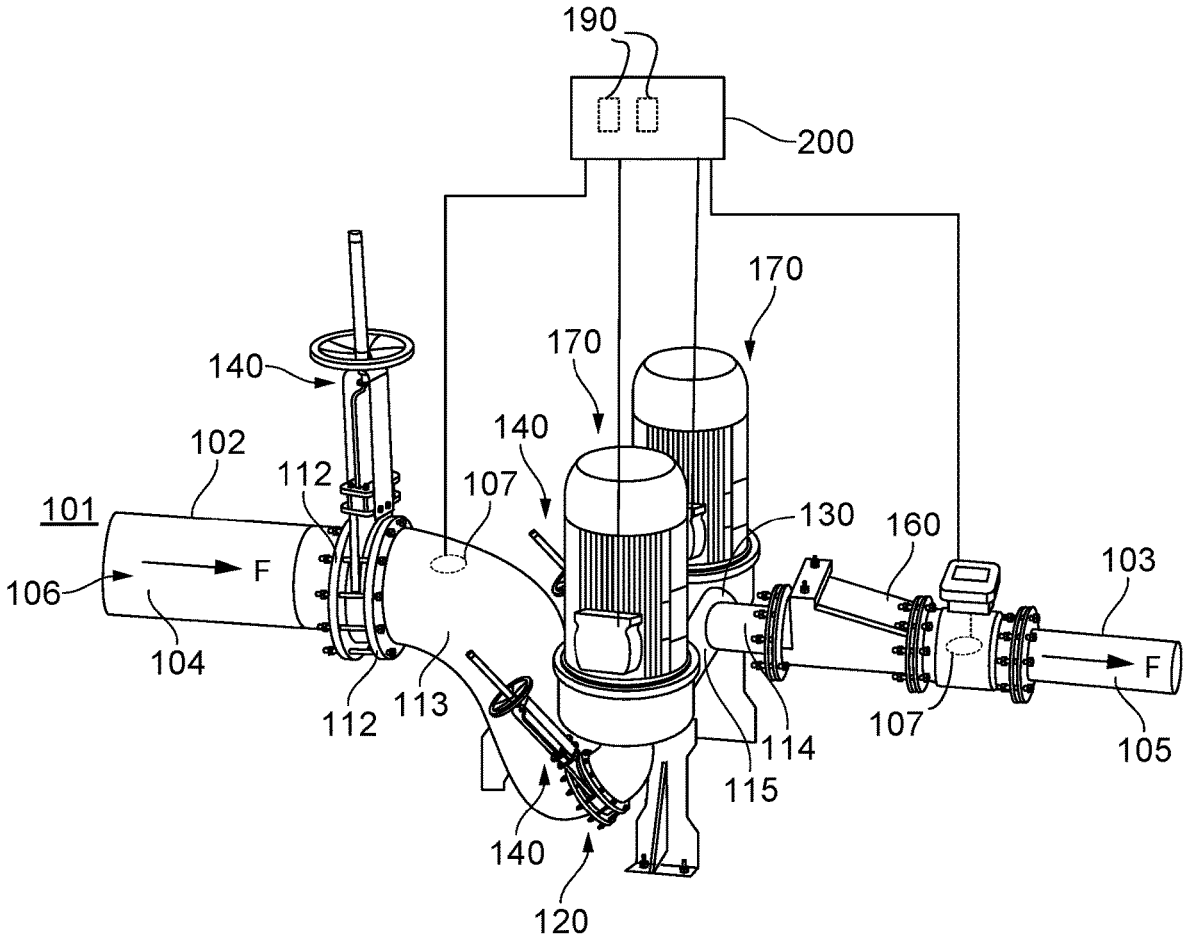
FIG. 6 is a perspective view illustrating the pumping apparatus, system and method according to an alternative embodiment of the present invention.

Referring to FIGS. 1 and 3-7, an embodiment of the invention uses one or more shutter valves 140 configured to secure to the liquid pumping apparatus and/or system 100 into the gravity feed network 101 and for servicing thereof. As illustrated in FIGS. 3 and 4, each of the one or more closure members 140 have a body 141 with an opening 142 for passing flow F there through. Each of the one or more valves 140 may be configured with a flange 143 for connecting to the inlet or outlet pipe 102, 103 of the gravity feed network 101 and another flange 143 on an opposite side for attaching to the flange 112 on the upstream and downstream portions 113, 114 so as to connect valves 140 to the main duct 110. The body 141 is configured to have a shutter aperture or opening 145 disposed on an interior portion movable to allow the shutter 145 to align with the opening 142. The shutter 145 is operably connected by arm 146 to a handle 147 connected through a seal 148 to the shutter 144 as shown in FIG. 3.

As is illustrated in FIG. 3, the liquid pumping apparatus and/or system 100 further comprises a shut-off or check valve 160 disposed in the manifold portion 115 for diverting the flow F such as, for example, a plug, ball, or flap type shut-off valve. The check valve 160 can be configured to operate between a first position 160*a* and a second position 160*b*. The check valve 160 can be configured in the open second position for flow F and in the closed first position for flow F'. The check valve 160 can be configured controllable to close in proportion to the speed difference between upstream and downstream flow, and to open completely at the same speed between upstream and downstream flow, as measured by one or more sensors 107 with the output electrical signals applied to the controller 190 and/or control system 200.

According to an embodiment of the invention, the main conduit 110 is equipped with a check valve 160 having a body 161 with an internal space and an access opening connecting to a cover plate 162. The internal area of the body 161 is configured to connect a hinge 165 by a hinge pin 166. A disc 163 may be connected to the hinge 165 by a nut 167 and stud bolt 168. The cover plate 162 may be secured and sealed using a gasket 169 to the manifold portion 115 using fasteners such as, for example, one or more nuts 167 and stud bolts 168. In operation, the inlet flow F into the internal area may be stopped by the disk 163 with body seats 164 in the first position 160*a* and open by moving to the second position 160*b* around the pivot of the hinge 165 connection to the body 161.

Referring to FIGS. 1-2 and 5-7, the liquid pumping apparatus and system 100 further comprises one or more pumps 170 comprises a motor housing 171, one or more motor controls 172 and motor sensors 173 for operably connecting a motor 180 to the flow F, for example, a standard asynchronous motor powered by a variable speed drive. Each pump 170 motor housing 171 connects to a pump body 174 having a lower pump body 175 configured to attach to the end 123 of the input connecting conduit 120 and having an upper pump body 176 configured to attach to the output connecting conduit 130. The motor 180 operation is advantageously reversible so as to turn a shaft thereof in a first forward direction (D) and a second reverse direction (R). The motor 180 is operably connected by the shaft to a rotor 181 located in the lower pump body 175 and to an impeller 188 for pumping the liquid by the rotation in the forward direction (D) by plates 185 located in the upper pump body 176. The rotor 181 can be formed as a disk 182 having the one or more blades 183 connected by a radial spindle 184 and a spindle connection portion 186 of the plate 185 to the disk 182. The plate 185 further has the one or more blades 183 on one side of the plate 185 that operate to provide liquid flow F' in the forward direction D to form a stop support for the impeller 188 and in reverse direction R to cut solids of flow F'. Each pump 170 may also include a check valve 160 at its discharge, designed to open at very low load or flow F out from the output connecting conduits 130.

A control 190 such as a Variable Frequency Drive (VFD) is operably connected to the one or more pumps 120 so as to operate, e.g. to start and stop, the one or more motors 180 depending on the filling level of the main conduit 110. A suitable control 190 is a VFD drive for start and speed manufactured by Danfoss, USA, Baltimore, Maryland under product name VLT® brand. The VFD drive can further be configured to have multiple pump-dedicated control features and an intelligent protection capability that is adapted to optimize liquid flow, protect the drive, the motor, and other equipment in the pumping apparatus and system 100. The control 190 is configured to receive signal input from the sensor probe 107, collect operational parameters, and to control the operation of the liquid pumping apparatus and/or system 100, for example, the control 190 constantly adjusts the pressure reference to a desired operational parameters such as a system curve.

The control 190 is configured to operate on real-time and stored parameters to lower operation, energy, and reduced installation costs using flow compensation in the liquid pumping system 100. According to an embodiment of the invention, the control 190 can be configured to control motor start and speed from sensor probe 107 input signals, to control the processing of liquid flow F' for smooth operation e.g. without damage to the check-valve 160 and/or other components, to control the motor 180 in variable torque applications, to reduce wear on the motor 180 and equipment, to improve reliability, to provide low energy consumption, to reduce motor repair & maintenance costs, and to maximize energy efficiency in AC-motor-driven liquid, water and wastewater applications. The control 190 and sensor 107 can be used to adjust the liquid pumping apparatus and/or system 100 for load variation of the flow F, F' in both new and retrofit liquid, water or wastewater treatment facilities and advantageously makes it economically feasible to introduce motor control on rotating equipment such as pumps.

A pressure transducer or sensor probe 107 mounted in the main conduit 110 close to the pump 170 provides a reference signal enabling the control 190 to maintain constant pressure at the discharge end of the liquid pumping apparatus and system 100. Suitable pumps 170 can be variable speed or servo control pumps. In hydraulic applications, for example, a servo control pump can be used to control the pressure or the volume of flow currently needed in the system 100. Depending on the type of actuation desired, electrically, pneumatically and hydraulically actuated valves and valves actuated by the fluid handled can be utilized. The control system 200 is designed to regulate the flow rate of the one or more pumps 170 according to a predetermined level of liquid flow in the main conduit 110 as determined by the sensor 107 such as, for example, the filling level of the main conduit 110 to be maintained, without the main conduit 110 being completely full, so as to significantly increase the flow rate F' to the downstream portion 114 from the upstream portion 113.

The pressure transducer or sensor 107 operably converts pressure into an analog electrical signal for transmittal to the control 190 and/or control system 200 of the liquid pumping apparatus and system 100 such as, for example, differential pressure transducer, strain gauge pressure transducers, optical pressure sensor, capacitance pressure transducers, potentiometric pressure transducers, and resonant wire pressure transducers. According to the invention, a strain gauge pressure transducer can convert pressure into an electrical signal by the physical deformation of strain gage that is bonded into the diaphragm of the pressure transducer and wired into a Wheatstone bridge configuration. Pressure applied to the pressure transducer 107 produces a deflection of the diaphragm that introduces strain to the gage, thereby an electrical resistance change proportional to the pressure.

According to the invention, a direct in-line liquid pumping apparatus and system 100 can be formed that is suitable for municipal, commercial and industrial wastewater applications. Such a direct in-line pumping system 100 advantageously eliminates a need for wet wells by pumping gravity fed effluent directly from the point of entry in the gravity feed network 101. Additional sensors 107 provide input to the control 190 and/or control system 200 that may be used for maintenance such as by installing a seal fail circuit, e.g. a device monitoring for the presence of moisture in the main conduit 110. Additional advantages of direct in-line pumping system 100 provides safe access, no dangerous gases, smells, sand and grease accumulation, as well as equipment corrosion, structural erosion and/or obstructed float valves. Accordingly a direct in-line pumping system 100 can be utilized in new installations and/or retrofits thereby saving on installation and downtime time and overall costs. Moreover, the direct in-line pumping system 100 can be formed with a wastewater pump driven by a variable speed drive providing continuously modulated pumping and to control advantageously energy costs by using the right amount of power when needed.

According to an embodiment of the invention, a direct in-line pumping system 100 can use a reversible pump 170 having an impeller 188 with shredder action provided by one or more blades 183 that automatically actuate by the control 190 and/or control system 200 changing the forward direction D to the reverse direction R and the one or more motors 180 so as to cut solids and long, fibrous materials thereby allowing for the passage of solids and other objects through the pump, prevent clogging, and to provide self-cleaning of the system and/or components thereof, e.g. pumps, pipes, and the like. The reversible pump 170 can include one or more motor controls 172 and one or more sensors 173 for remote management by the control 190 and/or control system 200 thereby saving on maintenance time and costs. According to an embodiment of the invention, a suitable solids handling reversible pump 170 is manufactured by BJM Pumps LLC, Old Saybrook, Connecticut, under the product name SVF Series having Vortex impellers for shredding of mud, raw sewage, viscous liquids, rags, wood chips and other solids, the SKG Series featuring RAD-AX® dual shredding designed to obliterate flushable wipes and other difficult solids in municipal and industrial wastewater applications, pumps featuring IP67 IE3 motors, and/or a reversible wastewater shredder pump.

Figure 7:
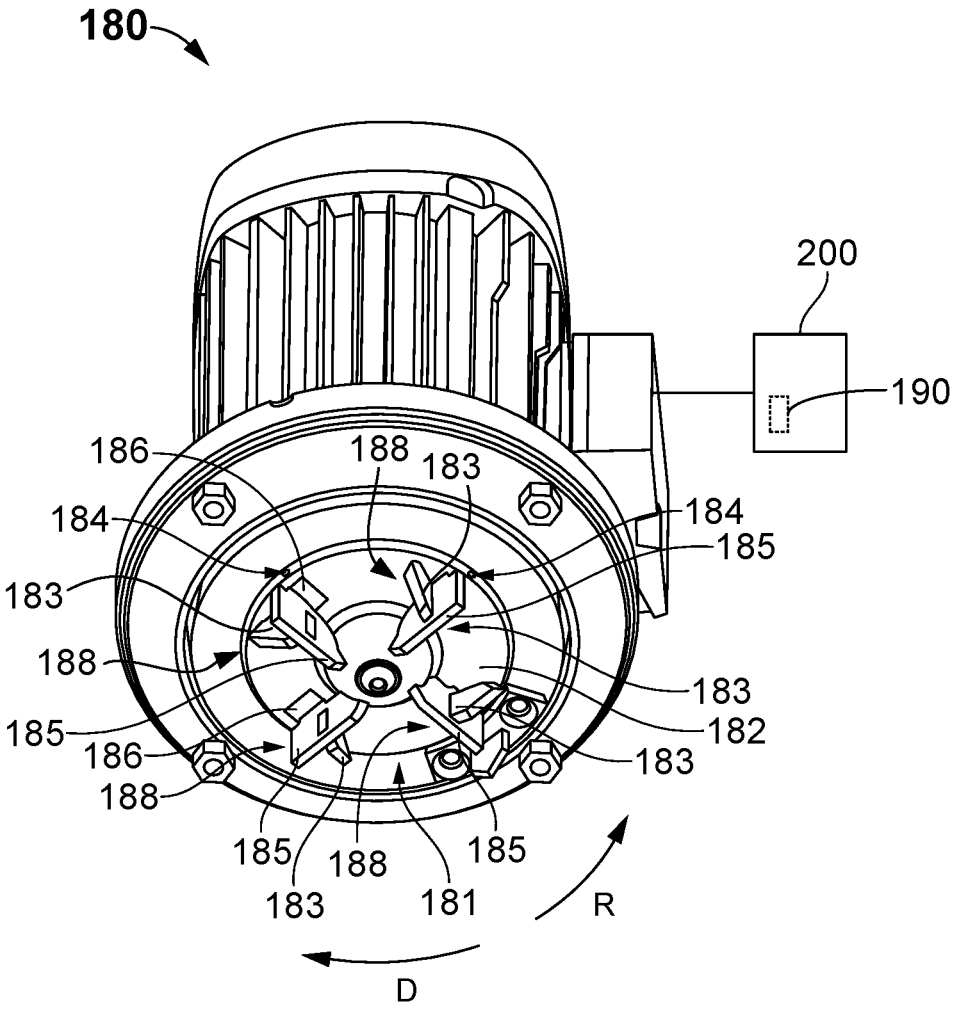
FIG. 7 is a perspective view illustrating the shredder pump according to an embodiment of the present invention

As shown in FIG. 7, the wastewater pump 170 can be a variable speed drive to allow for continuous modulated pumping directly from the effluent inlet to save energy. The wastewater pump 170 can comprise a reversible motor 180 driving a rotor 181 having an impeller 188 secured to a disc 182 having plates 185 having at least one blade 183. Each blade 183 is formed on one side of the plate 185 and attached by radial spindle 184 connecting to the spindle connection portion 186 of the plate 185. The blades provide support for the plate 185 in the forward direction D to operate as an impeller 188, i.e., by forming a prop supporting the plate 185 in the active position when the rotor 181 is rotating in the forward direction (D), and plate 185 projecting the one or more blades 183 in the peripheral direction when the rotor 181 turns in the reverse direction (R), i.e., the plate 185 being applied against the disc 182. Consequently, the impeller 188 serves as a shredder pump by changing its direction of rotation to cut fibrous materials and other solids to be able to pass through the pump 170 and advantageously provides a feature for a self-cleaning function to reduce maintenance and repair costs, which operation is as disclosed in U.S. Pat. No. 9,726,179 issued Aug. 18, 2017 and incorporated by reference.

The wastewater pump 170 can be operably connected to a control system 200 for automatically, manually, and/or remotely monitoring the liquid pumping apparatus and system 100. According to an embodiment of the invention, the control system 200 can be configured as a supervisory control and data acquisition (SCADA) system for gathering and analyzing real time data input from the pressure transducer 107, the closure members 140, the check valve 160, controls, and other sensors used to monitor and control the liquid pumping apparatus and system 100. The control system 200 can be configured for remote control management for resetting, unclogging and monitoring to save on maintenance time and costs. The control system may be formed from other computer operated control systems for gathering and analyzing real time data for configuring with the structures of the present invention.

While certain configurations of structures have been illustrated for the purposes of presenting the basic structures of the present invention, one of ordinary skill in the art will appreciate that other variations are possible which would still fall within the scope of the appended claims. For example, other variations can be made to the invention including adding of devices to accelerate the velocity-flow of a gravity channel with counter-slopes along its trajectory or path, or of a filled fluid channel. Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A system for moving wastewater in a gravity feed network having an inlet pipe and an outlet pipe, comprising:

a main conduit comprising a main body including an upstream portion, a downstream portion, and a manifold portion;

one or more inlet connecting conduits having an inlet body operably connected at a first end to said upstream portion proximate and above a nadir of said upstream portion, and at a second end to a pump body, said second end being disposed at an elevation above said first end;

one or more outlet connecting conduits having an outlet body operably connected at a third end to said downstream portion below the apex of said downstream portion said outlet body operably connected at another end to said pump body, said main conduit adapted to operably connect to said inlet pipe and said outlet pipe of the gravity feed network so as to move the wastewater;

a check valve operably connected in said manifold portion of said main conduit, said check valve operable between a first position and a second position to interrupt or resume the flow of wastewater through said manifold portion;

at least one sensor adapted to determine a predetermined value of the wastewater flow located in said main conduit;

one or more pumps, each pump coupled to one of said one or more inlet connecting conduits and to one of said one or more output connecting conduits, said one or more pumps being adapted to allow for the passage of solids and other waste objects through said pump, said one or more pumps further configured to prevent clogging of said one or more pumps; and a control electrically connected to each of said one or more pumps and to said sensor, said control adapted to energize said one or more pumps to thereby increase the velocity of the wastewater, said control energizing said one or more pumps when the arrival of the wastewater flow in said main conduit is above said predetermined value of the wastewater flow in said main conduit.

2. The system according to claim 1, further comprising one or more closure members operably connected to one or more flanges of said main conduit, a respective single closure member of said one or more closure members being located at said upstream portion and/or at said downstream portion.

3. The system according to claim 2, wherein said one or more closure members are selected from the group consisting of: a gate valve and a shutter valve.

4. The system according to claim 1, wherein said check valve is operably connected to said control so as to close said check valve to said first position to interrupt the liquid flow at a predetermined level detected by said sensor and/or to said second position when the liquid flow falls below said predetermined level detected by said sensor.

5. The system according to claim 1, wherein said one or more pumps comprise one or more motor controls operably connected to said control for energizing one or more motors at said predetermined level of the wastewater flow detected by said sensor.

6. The system according to claim 1, wherein said one or more pumps comprise one or more motor controls operably connected to said control for energizing one or more motors when said check valve is in said first position.

7. The system according to claim 1, wherein said upper pump body further comprises a check valve for limiting wastewater flow output from returning to said upper pump body.

8. The system according to claim 1, wherein said one or more pumps further comprise a variable frequency drive configured to operate said one or more pumps depending on the filling level of said main conduit.

9. The system according to claim 1, wherein said one or more pumps further comprise a variable frequency drive configured to operate said one or more pumps at or above said predetermined level of the wastewater flow detected by said sensor.

* * * * *